US006609634B2

(12) United States Patent
De Laforcade et al.

(10) Patent No.: US 6,609,634 B2
(45) Date of Patent: Aug. 26, 2003

(54) DISPENSING DEVICE AND METHODS

(75) Inventors: Vincent De Laforcade, Rambouillet (FR); Laure Bourjal, Clichy (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/947,463

(22) Filed: Sep. 7, 2001

(65) Prior Publication Data

US 2002/0036212 A1 Mar. 28, 2002

(30) Foreign Application Priority Data

Sep. 8, 2000 (FR) ..... 00 11473

(51) Int. Cl.[7] ..... G01F 11/00

(52) U.S. Cl. ..... 222/1; 222/81; 222/94; 222/145.5

(58) Field of Search ..... 222/1, 81, 83, 222/94, 145.5, 145.6, 546, 555, 563

(56) References Cited

U.S. PATENT DOCUMENTS 1,535,529 A * 4/1925 Hopkins ..... 222/485
1,639,699 A * 8/1927 Hopkins ..... 222/94
3,378,168 A * 4/1968 Hildebrandt ..... 206/222
3,406,872 A * 10/1968 Fiquet et al. ..... 222/499
4,340,154 A * 7/1982 VanManen ..... 222/136
4,687,663 A * 8/1987 Schaeffer ..... 222/1
5,076,470 A * 12/1991 Hatakeyama et al. ..... 222/132
5,419,459 A 5/1995 O'Meara ..... 222/83
6,003,728 A * 12/1999 Elliott ..... 206/219

FOREIGN PATENT DOCUMENTS

DE 23 50 773 4/1975
EP 0 564 208 10/1993

OTHER PUBLICATIONS

English language Derwent Abstract of DE 23 50 773, Apr. 24, 1975.

* cited by examiner

*Primary Examiner*—Joseph A. Kaufman
(74) *Attorney, Agent, or Firm*—Finnegan, Henderson, Farabow, Garrett & Dunner, LLP

(57) ABSTRACT

A dispensing device and related methods for jointly dispensing and separately storing two products. The dispensing device comprises a first container defining a first reservoir configured to hold a first product and a second container at least partially surrounding the first container. A second reservoir configured to hold a second product is defined between the first container and the second container. The dispensing device further comprises an outlet configured to permit flow of the first product and the second product from the device, and a flow control member. The flow control member is moveable from a first position in which the flow control member prevents flow of the first product from the first reservoirs, to a second position in which the flow control member permits flow of the first product. A closure is configured to be placed in a storage position in which the closure prevents flow of product through the outlet and prevents flow of the first product from the first reservoir.

192 Claims, 7 Drawing Sheets

DISPENSING DEVICE AND METHODS

FIELD OF INVENTION

The present invention generally relates to a device and related methods for the separate storage and joint dispensing of two products that are to be mixed together only at the time of use. At least one of the products may be in the form of a liquid, or in a more viscous form, such as in the form of a cream or of a paste, for example. Such a device may be used, although not exclusively, in the field of cosmetics, and particularly in the field of hair coloration, for example. The dispensing device also may be useful in other fields requiring the mixing of two products only upon use, such as in the field of two-part adhesives, for example.

BACKGROUND

In the field of hair coloration, some formulations are prepared from the extemporaneous mixing of a coloring part and an oxidizing part. The coloring part may itself be prepared from the extemporaneous mixing of two components, one of which may generally be in the form of a cream and the other of which, also known as a "booster", may be in liquid form.

Many conventional devices are designed for carrying out a more or less automatic extemporaneous mixing of two components intended for preparing a composition, particularly a hair composition. Such devices may be well-suited to handling liquid components. They generally are less suitable when one of the components is in the form of a cream.

Preparing the coloring part of the hair coloring formulation referenced above may require close adherence to precise respective dosages of the two components from which it is prepared. If such dosages are not adhered to, there may be a significant impact on the color obtained. One solution, therefore, may be to provide the consumer with only the amount needed for a single use. In this case, the consumer empties the entire contents of each of the containers containing each of the compounds. The respective dosages may thus be adhered to. However, there may be a need for coloring kits that can be used in several stages, without thereby increasing the number of packages, which, from an economical point of view and from an environmental-protection point of view, may be undesirable.

An optional aspect of the invention may be to produce a device which, in a unit assembly, makes it possible to separately store two products with a view to extemporaneously mixing them during dispensing and wherein the dispensing may be broken down into several stages, with the two products being kept separate in the device throughout the life of the products.

Another optional aspect of the present invention may be to provide a device that may make it possible for the two products to be dispensed in relatively precise respective dosages that can be substantially repeated upon each use.

A further optional aspect of the invention may be to produce a device which is both economical to produce and/or simple to use.

Other optional aspects will become apparent in the description which follows.

The inventive devices and methods of dispensing that will be described herein may optionally solve some or all of the problems discussed above with reference to conventional dispensing devices and methods. It should be understood that the invention could be practiced without performing one or more of the optional aspects and/or advantages described above.

SUMMARY

According to an optional aspect of the invention, a dispensing device comprises a first container defining a first reservoir configured to hold a first product and a second container at least partially surrounding the first container. The first container and the second container may define therebetween a second reservoir configured to hold a second product. The device may further comprise an outlet configured to permit flow of the first product and the second product from the device, and a flow control member moveable from a first position in which the flow control member prevents flow of the first product from the first reservoir, to a second position in which the flow control member permits flow of the first product from the first reservoir. A closure may be configured to be placed in a storage position in which the closure prevents flow of product through the outlet and prevents flow of the first product from the first reservoir.

Optionally, in the storage position, the closure may be configured to prevent flow communication between the first reservoir and the second reservoir. The first reservoir and the second reservoir may also be in flow communication with each other when the closure is moved from the storage position and the flow control member is in the second position.

According to yet another optional aspect of the invention, a dispensing device comprises a first container defining a first reservoir configured to hold a first product and a second container at least partially surrounding the first container. The first container and the second container may define therebetween a second reservoir configured to hold a second product. The dispensing device may further comprise an outlet configured to permit flow of the first product and the second product from the device and a flow control member moveable from a first position in which the flow control member prevents flow communication between the first reservoir and the second reservoir, to a second position in which the flow control member permits flow communication between the first reservoir and the second reservoir. A closure may be configured to be placed in a storage position in which the closure prevents flow of product through the outlet and prevents flow communication between the first reservoir and the second reservoir.

Optionally, flow communication between the first reservoir and the second reservoir may be prevented when one of the closure is in the storage position and the flow control member is in the first position. Also optionally, in the storage position, the closure may be configured to prevent flow of the first product from the first reservoir.

Movement of the closure to the storage position at least prior to a first use of the device for dispensing the first and second products optionally places the flow control member in the second position. Also optionally, when the closure is in the storage position, the closure may be configured to prevent flow of the first product via the flow control member when the flow control member is in the second position.

Movement of the closure to and from the storage position may be reversible. The dispensing device, according to another optional aspect of the invention, comprises an opening associated with the first container for flowing the first product from the first reservoir. The flow control member may be configured to close the opening in the first position. Optionally, the flow control member comprises a solid portion configured to close the opening when the flow control member is in the first position. As another option, the flow control member defines at least one passage, the at least one passage providing flow communication between the first reservoir and the second reservoir when the flow control member is in the second position. The flow control member also optionally comprises an annular rim configured to abut a free edge of the first container defining the opening when the flow control member is in the second position.

The dispensing device may further comprise an opening associated with the first container for flowing the first product from the first reservoir. The opening may be disposed at an axial position differing from the axial position of the outlet.

At least prior to a first use of the device for dispensing the first and second products, the closure may optionally be spaced from the flow control member. The opening optionally may be configured to be closed at least partially by the closure when the closure is in the storage position. The closure may include a stopper portion configured to plug the opening and a skirt portion surrounding the stopper portion. The skirt portion optionally covers the outlet when the closure is in the storage position. Also as an option, the skirt portion may include screw threading. The dispensing device optionally may comprise a neck portion including screw threading and the screw threading on the closure may be configured to engage with screw threading on a neck portion. The second container may be connected to the neck portion, and, optionally, the second container and the neck portion may be a single piece. As yet another option, the closure may be configured to close the outlet to prevent flow of product through the outlet and to simultaneously close the opening when the closure is in the storage position.

The closure of the dispensing device optionally includes screw threading configured to engage with screw threading on a portion of the second container and the closure optionally may be configured to be placed in the storage position by screwing the closure onto a portion of the second container.

The dispensing device according to yet another optional embodiment may comprise a protective sealing element configured to seal the outlet prior to a first use of the device for dispensing the first and second products. The closure optionally comprises a sharpened member configured to pierce the sealing element. The sharpened member may optionally be configured to pierce the sealing element when the closure is placed in the storage configuration prior to the first use of the device for dispensing.

The first container and the second container optionally may have substantially the same axial height. Also optionally, the device may be configured such that a flow rate of each of the first product and the second product during dispensing of the first and second products is a function of a ratio of the transverse cross-section of the first container and the transverse cross-section the second container. As yet another option, the first container and the second container may have an integral, single piece construction.

Movement of the closure to the storage position at least prior to a first use of the device may cause movement of the flow control member to the second position. Optionally, the flow control member is in the first position at least prior to a first use of the dispensing device for dispensing product.

The dispensing device also may comprise a flange element configured to prevent the closure from moving to the storage position prior to a first use of the device for dispensing the first and second products.

Optionally the flange element is detachable. Also optionally, the dispensing device may comprise a neck portion and the flange element may be in the form of a ring configured to surround the neck portion. The neck portion optionally comprises screw threading configured to engage with screw threading on the closure, and the ring optionally is configured to surround at least part of the screw threading on the neck portion.

At least part of the second container may optionally be made of a deformable material. Also as an option, at least part of the second container may be in the form of a tube. As yet another option, at least part of the second container may be made by one of molding and extruding. At least the part of the second container optionally may be made of a material chosen from aluminum and a multi-layer complex comprising at least one layer of aluminum. Aluminum may provide a barrier to oxygen, to which hair products and the like may be highly sensitive. At least part of the first container optionally may be made of a deformable material. Also optionally, the first container may be in the form of a bag.

According to yet another optional aspect of the invention, pressure exerted on the second container causes the first product and the second product to flow together from the outlet when the flow control member is in the second position and the closure is not in the storage position.

The dispensing device may further comprise a mounting member for mounting the first container within the second container. The mounting member may define at least one passage for flowing the second product from the second reservoir.

According to another optional aspect, the dispensing device further comprises the first product and the second product, and at least one of the first product, the second product, and a mixture of the first and second products is a product intended to be applied to at least one of one of hair, skin, and nails. Optionally, at least one of the first product, the second product, and a mixture of the first and second products is a product for coloring hair.

According to yet another optional aspect of the invention, a method of dispensing comprises providing a dispensing device, placing the flow control member in the second position, moving the closure from the storage position, and flowing the first product and the second product through the outlet.

Optionally, the placing of the flow control member comprises placing the closure in the storage position at least prior to a first use of the device for dispensing.

The closure may comprise screw threading configured to engage with screw threading on a portion of the device and the method optionally further comprises placing the closure in the storage position by screwing the closure on the device. The moving of the closure from the storage position may comprise unscrewing the closure from the device.

The flowing of the first product and the second product from the outlet optionally comprises exerting pressure on the second container. Also optionally, the moving of the closure from the storage position places the first reservoir and the second reservoir in flow communication with each other. As yet another option, the moving of the closure from the storage position may permit the first product to flow from the first reservoir.

The dispensing device may further comprise a sealing element configured to seal the outlet prior to a first use of the dispensing device for dispensing, and the method may further comprise moving at least a portion of the sealing element to enable flow via the outlet. Optionally, the closure comprises a sharpened member and the moving of the sealing element comprises piercing the sealing element with the sharpened member.

Yet another optional aspect of the invention includes a method of making a dispensing device. The method may comprise providing the first container, placing the flow control member in the first position, and filling the first reservoir with the first product. The method may further comprise sealing the outlet, inserting the first container within the second container, and filling the second reservoir with the second product.

As an option, the method further comprises filling the first reservoir through an open end of the first container and, also optionally, sealing the open end of the first container after the filling of the first reservoir. As yet another option, the method further comprises filling the second reservoir through an open end of the second container, and, also optionally, sealing the open end of the second container after the filling of the second reservoir.

According to yet another optional aspect, the method may comprise positioning the first and second containers in an inverted position during the filling of the first reservoir and the second reservoir. Optionally, the sealing of the outlet comprises sealing the outlet with a sealing element.

A neck portion optionally is associated with the second container and the method optionally further comprises placing a flange element around at least part of the neck portion. The method also optionally further comprises providing the closure on the neck portion above the flange element.

According to yet another optional aspect, the invention comprises a method of storing and dispensing first and second products. The method may comprise providing a dispensing device and preventing via the flow control member flow communication between the first reservoir and the second reservoir prior to a first dispensing of the first product and the second product. The method may further comprise moving the flow control member so as to place the first reservoir in flow communication with the second reservoir and flowing the first product and the second product from the first reservoir and the second reservoir, respectively, and out of the device. After flowing the first product and the second product out of the device, the method may comprise preventing, other than via the flow control member, flow communication between the first reservoir and the second reservoir.

Optionally, the moving of the flow control member comprises moving the flow control member to the second position. Also optionally, the preventing via the flow control member comprises preventing the first product to flow from the first reservoir. As yet another option, the preventing other than via the flow control member comprises preventing via the closure placed in the storage position.

The flowing of the first and second products out of the device optionally comprises flowing the first and second products through the outlet. The flowing of the first and second products may include exerting pressure on the second container.

Optionally, the moving of the flow control member occurs at least prior to a first flowing of the first and second products out of the device.

Yet another optional aspect of the invention includes a method of storing and dispensing first and second products, comprising providing a device comprising at least a first reservoir containing a first product, a second reservoir containing a second product, and a flow control member. The method may further comprise preventing via the flow control member flow communication between the first reservoir and the second reservoir prior to a first dispensing of the first product and the second product and moving the flow control member so as to place the first reservoir in flow communication with the second reservoir. The method may further comprise flowing the first product and the second product from the first reservoir and the second reservoir, respectively, and out of the device. After flowing the first product and the second product out of the device, the method may comprise preventing, other than via the flow control member, flow communication between the first reservoir and the second reservoir.

Optionally, the flowing of the first and second products includes exerting pressure on a portion of the device. Also optionally, the portion of the device defines the second reservoir.

Arranging one of the containers inside the other may allow the two products to be dispensed, in a single action, optionally via simple pressure exerted on the walls of the outer container. Through configuring the two containers appropriately, this single action may facilitate the adherence to the desired respective dosages of each of the two products during dispensing. As the switch from the storage position is reversible, the two products can be kept isolated from flow communication with each other throughout the life of the device.

In the case of a coloring composition, the ratio of the dosages between the first product and the second product optionally ranges from approximately 0.02 to approximately 0.2, or optionally from approximately 0.05 to approximately 0.2. For the specific application of hair coloring, the product contained in the first container may be in liquid form while the product contained in the second container may be in the form of a cream.

When the opening of the inner container is situated at a separate axial position from the axial position of the outlet of the device, the opening may play no part in reducing the cross-section of the outlet. This may make it possible to ensure dispensing at a high enough flow rate without the need to use a dispensing outlet of excessively large cross-section. Furthermore, with such an offset arrangement, the two products may be brought into close contact upstream of the outlet, which may make mixing them easier.

Plugging the opening of the inner container via the flow control member prior to first use of the device, and via other than the flow control member after first use may produce a structure that, prior to first use, makes it possible, on the one hand, to ensure that the device is appropriately isolated from the outside and, on the other hand, to ensure that the first product is isolated from the second product.

In the storage position, the closure may close both the outlet and the opening of the first container. Thus, to close the device again after first use, then subsequently after each later use, there optionally is just a single structure to be manipulated. This may make the action easier, while at the same time ensuring correct separation of the two products throughout the life of the device.

Aside from the structural and procedural arrangements set forth above, the invention could include a number of other arrangements, such as those explained hereinafter. It is to be understood that both the foregoing description and the following description are exemplary.

BRIEF DESCRIPTION OF DRAWINGS

The accompanying drawings are incorporated in and constitute a part of this specification. The drawings illustrate optional embodiments of the invention and, together with the description, serve to explain some principles of the invention. In the drawings.

DESCRIPTION OF EXEMPLARY EMBODIMENTS

Figure 1:
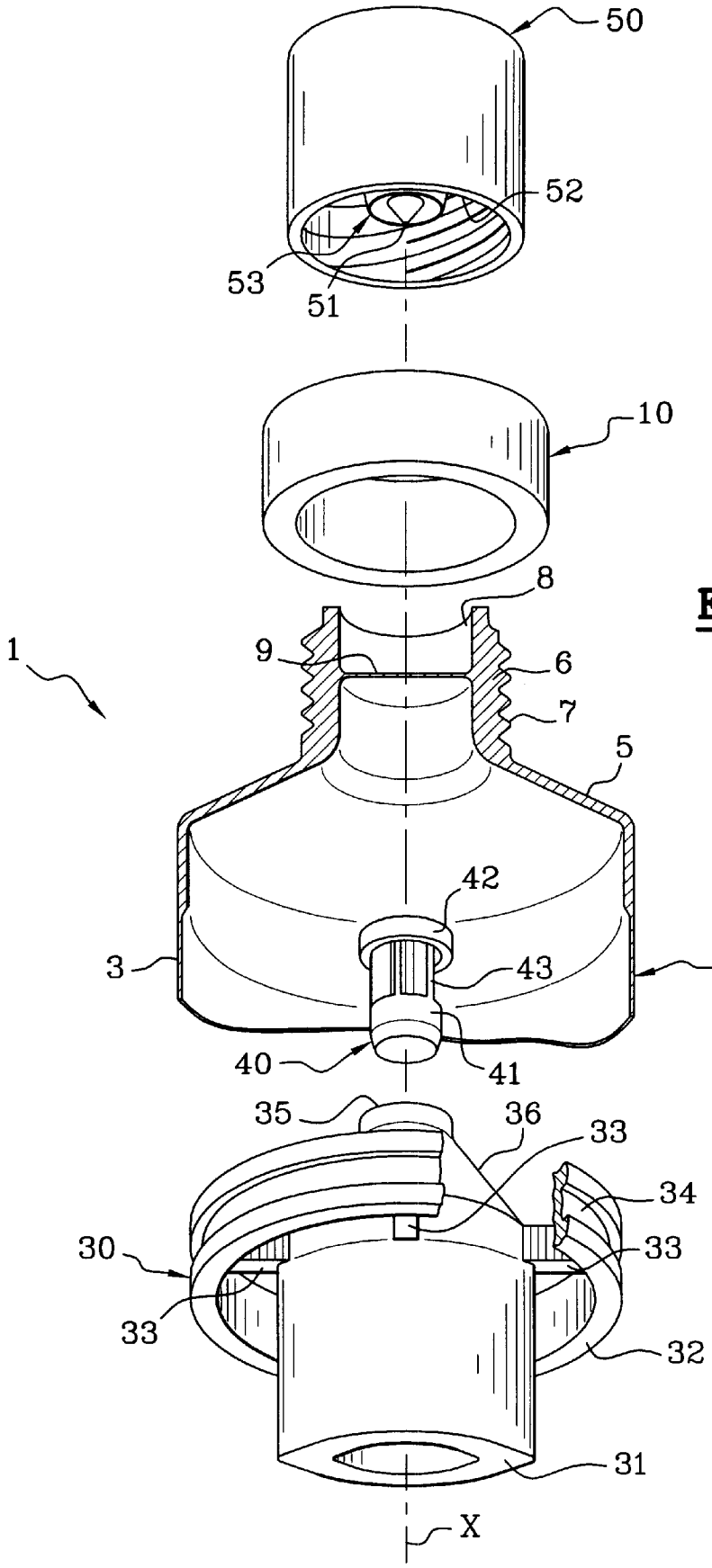
FIG. 1 is a partial exploded view of various parts of a dispensing device according to an optional aspect of the invention.

Reference will now be made in detail to the present preferred embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

FIGS. 1, 2A–2B and 3, to which reference is now made, illustrate one optional embodiment of a dispensing device 1 according to the invention. The device 1 as depicted partially in FIGS. 1 and 3 may comprise a first container 20 and a second container 2 that at least partially surrounds the first container 20. The second container 2 has a longitudinal axis X. The second container 2 may be in the form of an aluminum tube, for example. The second container 2 may have a body 3, an end 4 (FIGS. 4C–4H) of which may be sealed by folding, by welding, or by other suitable mechanisms. The second container 2 may have a shoulder 5 surmounted by a neck portion 6 equipped with screw threading 7. The neck portion 6 may be separate from the second container 2 or formed as a single piece with the second container 2. The neck portion 6 may have a free edge delimiting an opening 8, forming a dispensing outlet of the device 1. The wall thickness at the upper end of the body 3 and at the shoulder 5 may be greater than the wall thickness over the rest of the second container 2 so that, as will be explained later, a mounting member 30 of the first container 20 may be mounted inside the second container 2. In an optional embodiment, the first container 20 may be in the form of a bag, for example.

A protective sealing element (membrane) 9, which may provide evidence of tampering and better isolation between the contents inside the device and the outside, may be formed inside the neck portion 6. When the second container 2 is in the form of a tube, it may be extruded and the protective sealing element 9 may be formed during the extrusion inside the neck portion 6.

A flange element, which may be in the form of a ring 10, and which may be made, for example, of plastic and whose function will become apparent in greater detail later, and a stopper 50, also optionally made of plastic and one of whose functions is to seal the dispensing outlet 8, may be placed on the neck portion 6. The stopper 50 and the ring 10 will be described in more detail later.

Figure 2A:
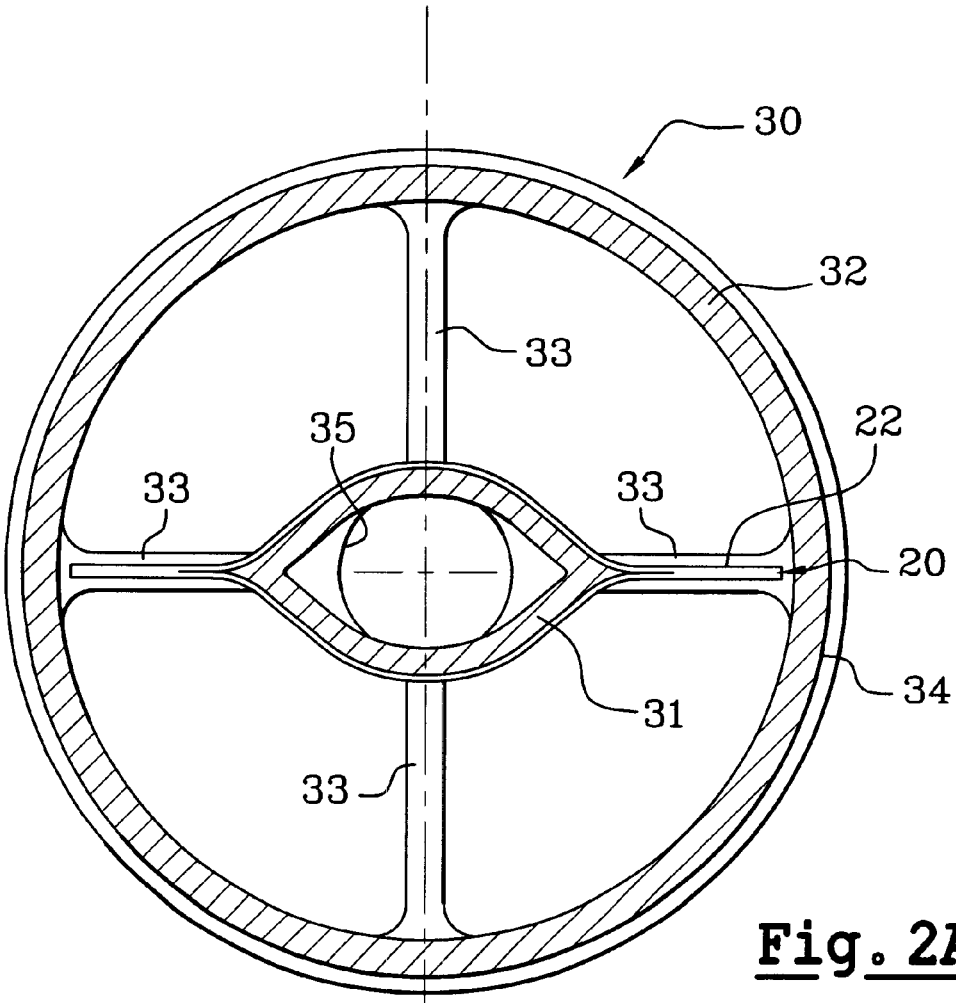
FIG. 2A is a top view of a mounting member shown in FIG. 1.
Figure 3:
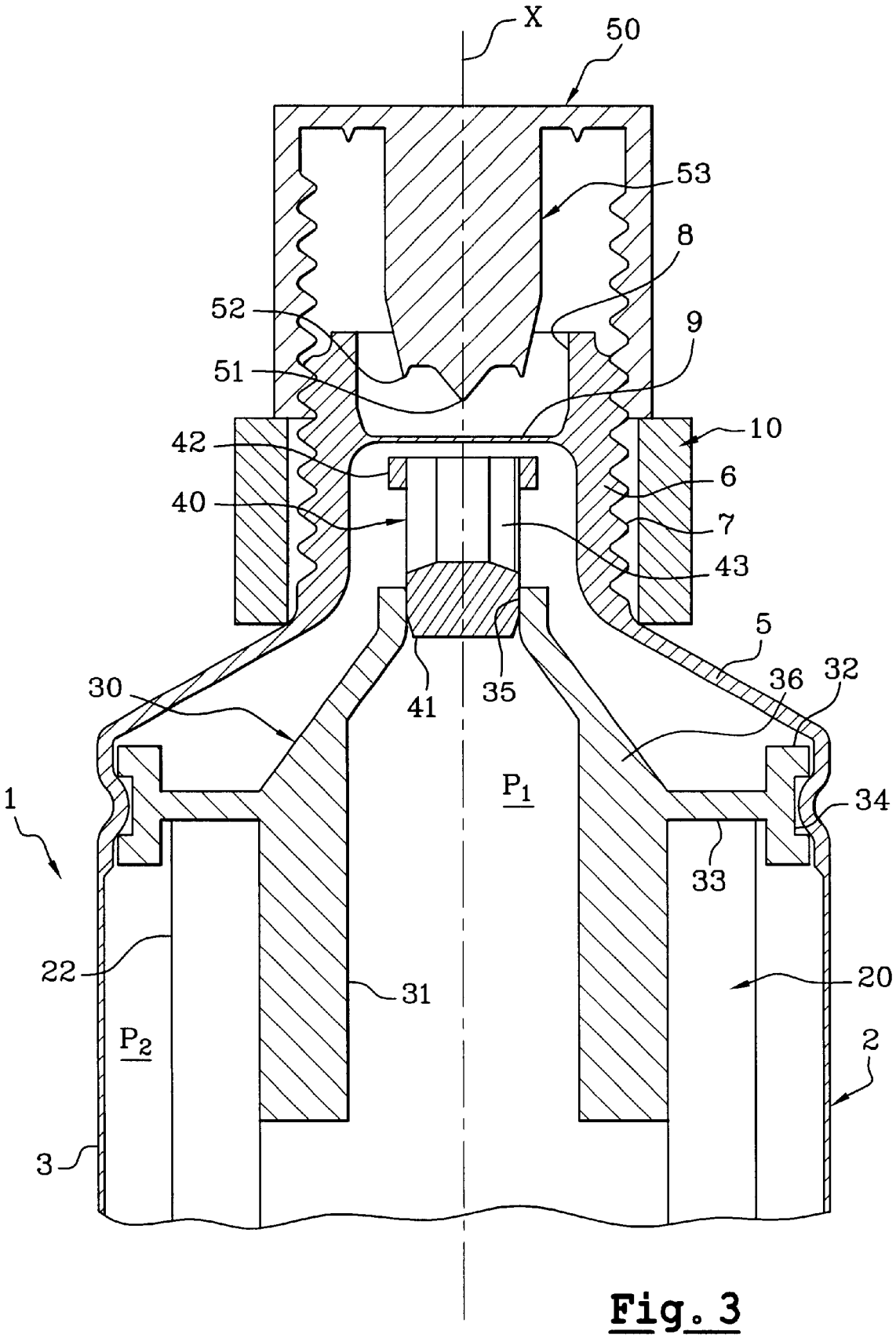
FIG. 3 is a partial cross-sectional view of the dispensing device of FIG. 1 in an assembled configuration prior to a first use of the dispensing device.

As can be seen in FIG. 3, a the first container 20, which may be in the form of a bag made of aluminum complex, for example, and sealed along three of its sides, may be placed inside the second container 2, which may be in the form of a tube, for example. The maximum width of the first container 20 may be less than the interior width of the second container 2. An end portion 22 of the first container 20, disposed at an opposite side to the end 21 (FIGS. 4A–4H), may be mounted on a mounting member 30, a top view of which is depicted in FIG. 2A.

The mounting member 30 has a skirt 31, the elongate section of which may be in the shape of an "eye", as shown, for example, in FIG. 2A. The side 22 of the bag 20 may be sealed, for example, by welding or bonding, to the skirt 31. The skirt 31 may connect to a mounting collar 32 via a number of tabs 33 spaced approximately 90° apart. The exterior surface of the mounting collar 32 may form an annular depression 34 capable of allowing the tube 2 (at the upper part of its body) to be crimped onto the end piece 30.

When the first container 20 is in position inside the second container 2, two reservoirs (i.e., volumes) are defined. A first reservoir may be defined inside the first container 20. The first reservoir may contain a first product P, for example, in liquid form. The second reservoir may be defined between the first container 20 and the second container 2. The second reservoir may contain a second product P2, for example, in the form of a cream. The first and second products may be mixed together during dispensing. As will be explained in more detail later, the two reservoirs may be kept substantially isolated from flow communication with one another between uses throughout the life of the device.

Opposite to the side of the skirt 31 having the elongate section, the mounting member 30 may be extended by a portion 36 that tapers in the direction of a free edge. The free edge may define an opening 35 comprising an outlet orifice of the first container 20. The opening may have a substantially circular cross-section, for example. As is apparent from FIG. 3, the opening 35 delimited by the mounting member 30 may be approximately level with the base of the neck portion 6 of the second container 2. Through this arrangement, the products $P_1$ and $P_2$ may be brought into contact upstream of the dispensing outlet 8.

Figure 2B:
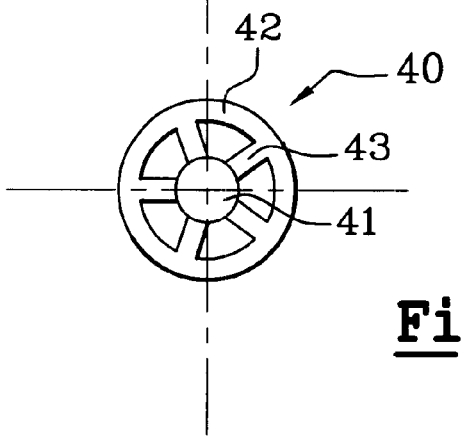
FIG. 2B is a top view of a flow control member shown in FIG. 1.

Prior to a first use of the device 1 for dispensing, the opening 35 of the inner container 20 may be plugged in a sealed manner by a flow control member 40, which may be in the form of stopper or plug. A top view of the flow control member 40 is illustrated in FIG. 2B. Prior to first use, the flow control member 40 may be housed underneath the sealing element 9. The flow control member 40 may have a solid portion 41 configured to be forcibly inserted into the opening 35 delimited by the mounting member 30 so as to plug the opening 35 in a sealed manner. Opposite the solid portion 41, the flow control member 40 may form an annular rim 42 intended, as will be seen later, to form a retainer to prevent the flow control member 40 from dropping into the first container 20 when axial pressure is exerted on it. The solid portion 41 may be connected to the annular rim 42 by a series of tabs 43 spaced uniformly apart so that when the rim 42 of the stopper 40 abuts against the edge of the mounting member 30, passages, defined between the tabs 43, allow product to be expelled from the first container 20.

The device 1 also may be equipped with a closure 50 configured to screw onto the neck portion 6 so as to plug the dispensing outlet 8. A transverse wall of the stopper 50 may carry an axial stopper member 53 facing towards the inside of the device 1. The end of the stopper member may be sharpened so as to form a protrusion (i.e., trocar) 51. The trocar 51 is capable (once the flange ring 10 has been removed), upon first use, of tearing the sealing element 9. When the ring 10 is mounted on the neck portion 6, which corresponds to the configuration of the device 1 prior to first use (see FIG. 3), the trocar 51 may be at a distance from the membrane 9 so that the latter cannot be torn accidentally.

Once the ring 10 has been removed (prior to first use), the trocar 51 may come into engagement with the sealing element 9 by screwing the closure 50 downward in order to tear (i.e., move) the sealing element 9. Also, the stopper member 53 carried by the closure 50 may come into engagement with the flow control member 40 and push it in until the rim 42 abuts against the edge of the mounting member 30. In this position with the closure 50 screwed fully on, an annular lip 52 formed at the end of the stopper member 53 may come into sealed engagement with the annular rim 42 of the flow control member 40 so that at maximum insertion the stopper 53 plugs both the opening 35 and the dispensing outlet 8 (see FIGS. 5D and 5F). Thus, the closure 50 on the one hand may isolate the two products from the outside and, on the other hand, may isolate the contents of the first reservoir formed by inside the first container 20 from the contents of the second reservoir formed between the first container 20 and the second container 2.

The stages involved in assembling a dispensing device, such as the one described with reference to FIGS. 1–3, are illustrated schematically in FIGS. 4A–4H, to which reference will now be made.

Figure 4D:
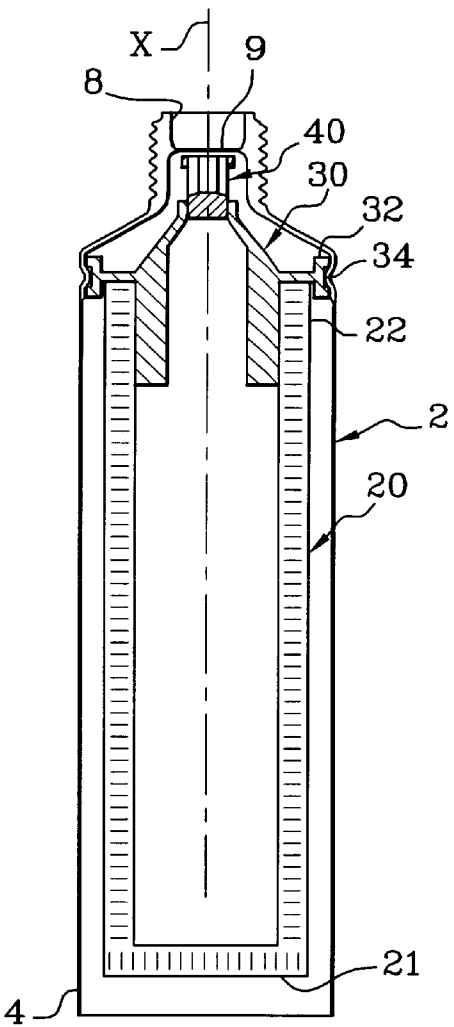
FIG. 4D is a cross-sectional view of an optional embodiment of another stage of making a dispensing device.
Figure 4C:
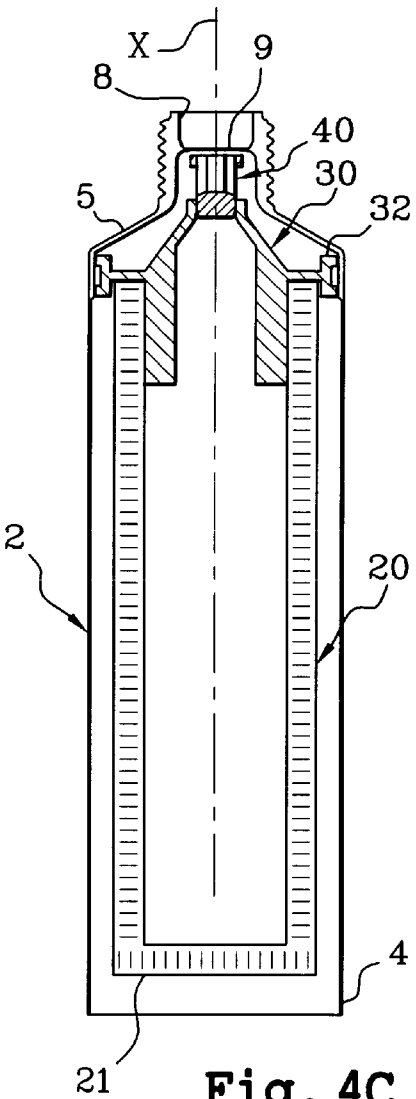
FIG. 4C is a cross-sectional view of an optional embodiment of yet another stage of making a dispensing device.
Figure 4B:
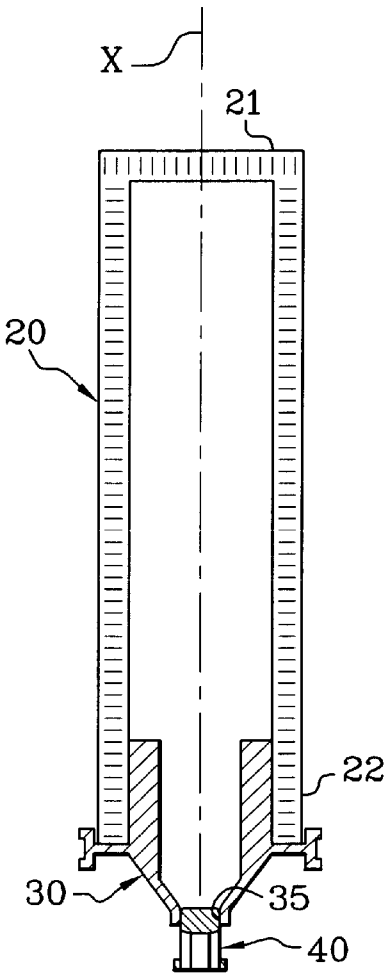
FIG. 4B is a cross-sectional view of an optional embodiment of another stage of making a dispensing device.
Figure 4A:
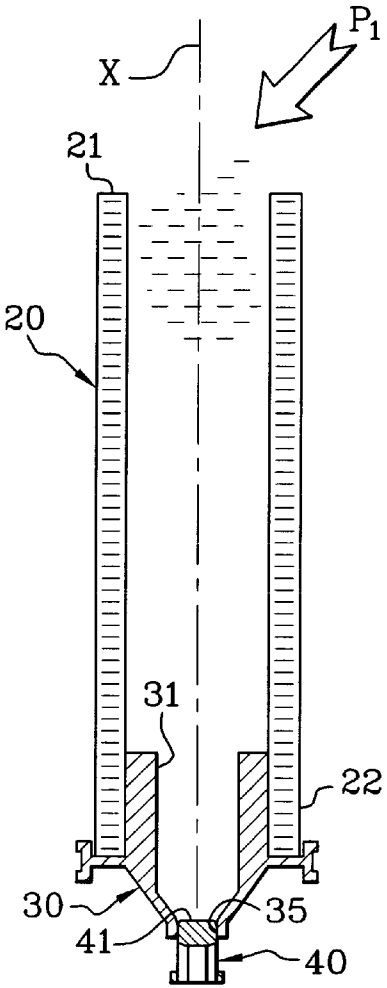
FIG. 4A is a cross-sectional view of an optional embodiment of a stage of making a dispensing device.

In FIG. 4A, the opening 35 of the mounting member 30 is plugged by the solid portion 41 of the flow control member 40. The first container 20 (the bottom 21 of which is open) may be welded to the skirt 31 of the mounting member 30. Once the assembly has been inverted, the first product P, may be introduced into the first reservoir inside the first container 20, via the open bottom end 21 of the first container 20. The bottom 21 of the first container 20 may then be sealed, for example, by welding or other suitable sealing mechanisms, as shown in FIG. 4B.

FIG. 4C shows the assembly comprising the first container 20 and the mounting member 30 being introduced into the second container 2 until the annular collar 32 of the mounting member 30 abuts against the shoulder 5 of the second container 2. In this position, the top of the flow control member 40 may lie just below the seal element 9 of the outlet 8. As shown in FIG. 4D, the second container 2 may then be crimped onto the mounting member 30 at the depression 34 formed on the exterior surface of the annular collar 32.

Figure 4H:
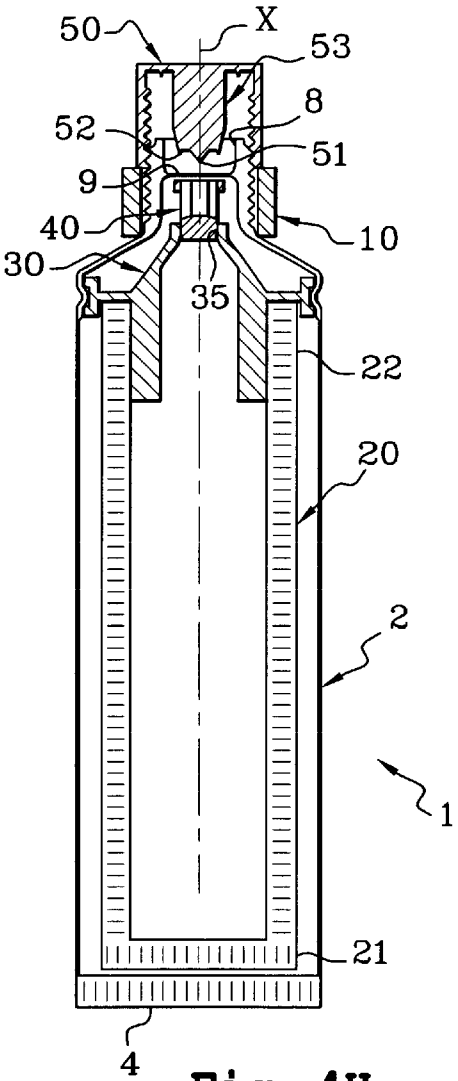
FIG. 4H is a cross-sectional view of an optional embodiment of yet another stage of making a dispensing device.
Figure 4G:
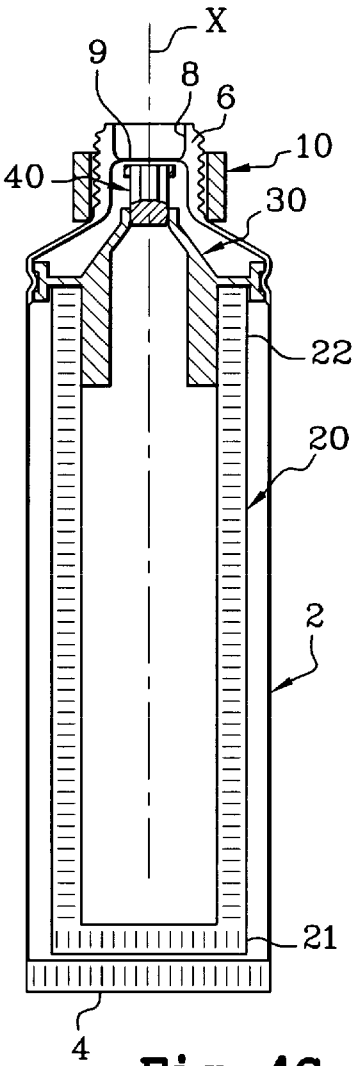
FIG. 4G is a cross-sectional view of an optional embodiment of yet another stage of making a dispensing device.
Figure 4F:
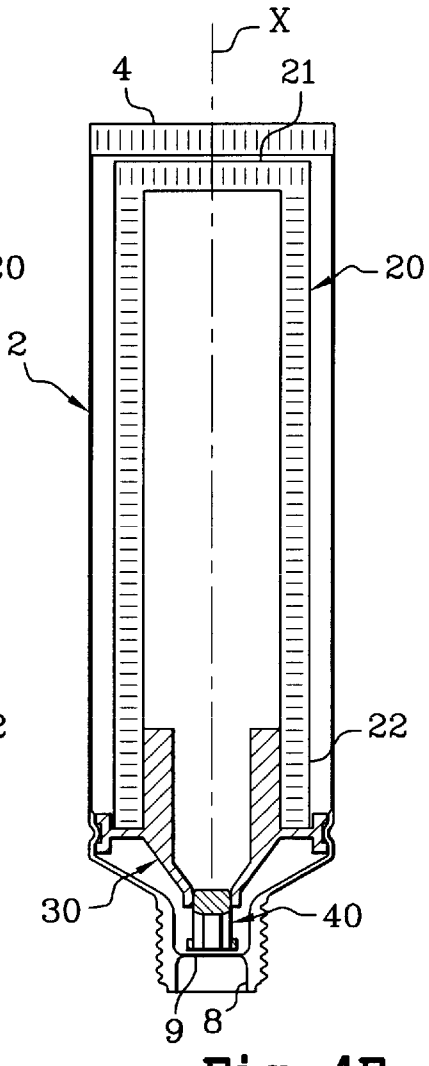
FIG. 4F is a cross-sectional view of an optional embodiment of another stage of making a dispensing device.
Figure 4E:
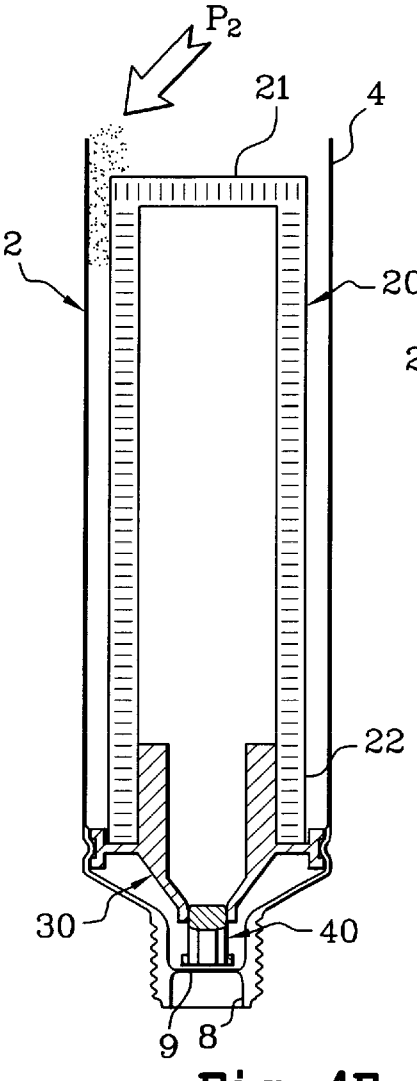
FIG. 4E is a cross-sectional view of an optional embodiment of another stage of making a dispensing device.

The assembly may then be inverted again and the second product P2 may be introduced, through an open end 4 of the second container 2, into the second reservoir formed between the first container 20 and the second container 2, as depicted in FIG. 4E. FIG. 4F shows the bottom end 4 of the second container 2 being sealed by welding after the second product $P_2$ has been introduced. Aside from welding, the bottom end 4 of the second container 2 may be sealed by any other suitable sealing mechanisms. The ring 10 may then be mounted on the neck portion 6 of the second container 2, as shown in FIG. 4G.

Although not shown, it is envisioned that the second container 2 and the first container 20 could be formed as a single piece.

FIG. 4H shows the closure 50 being screwed onto the neck portion 6 of the second container 2 until it abuts against the ring 10. In this position, the trocar 51, formed at the end of the stopper member 53 of the closure 50, is at a distance from the seal element 9. The device 1 is then ready for use.

An optional embodiment of a method for using the assembled dispensing device 1 is illustrated in FIGS. 5A–5F, to which reference is now made.

Figure 5C:
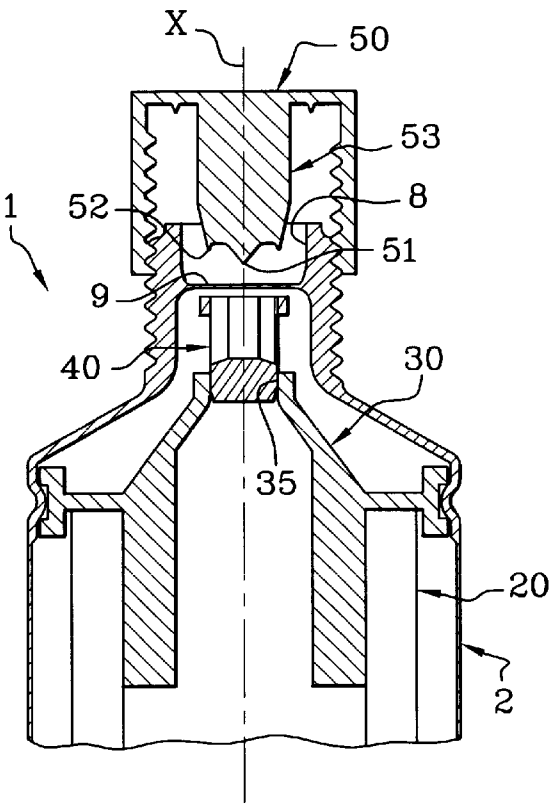
FIG. 5C is a partial cross-sectional view of an optional embodiment of yet another stage of using a dispensing device.
Figure 5B:
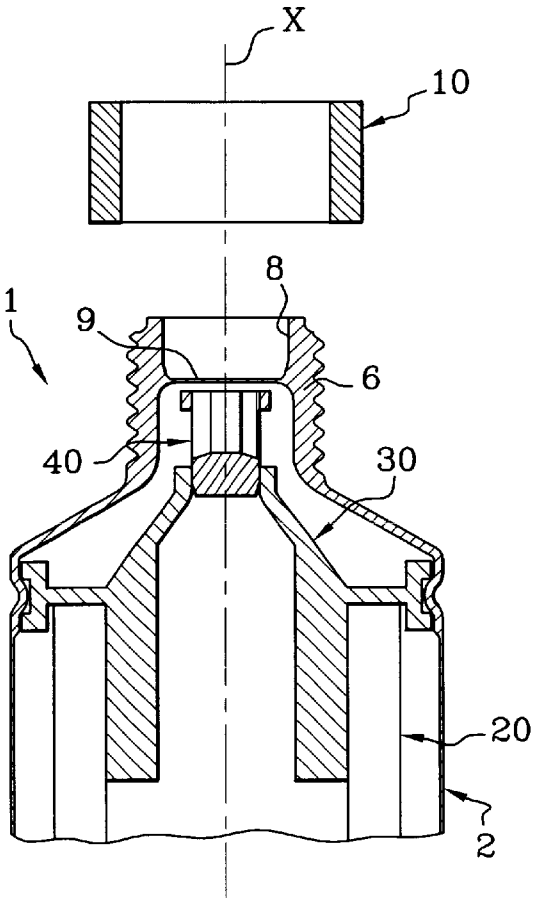
FIG. 5B is a partial cross-sectional view of an optional embodiment of another stage of using a dispensing device.
Figure 5A:
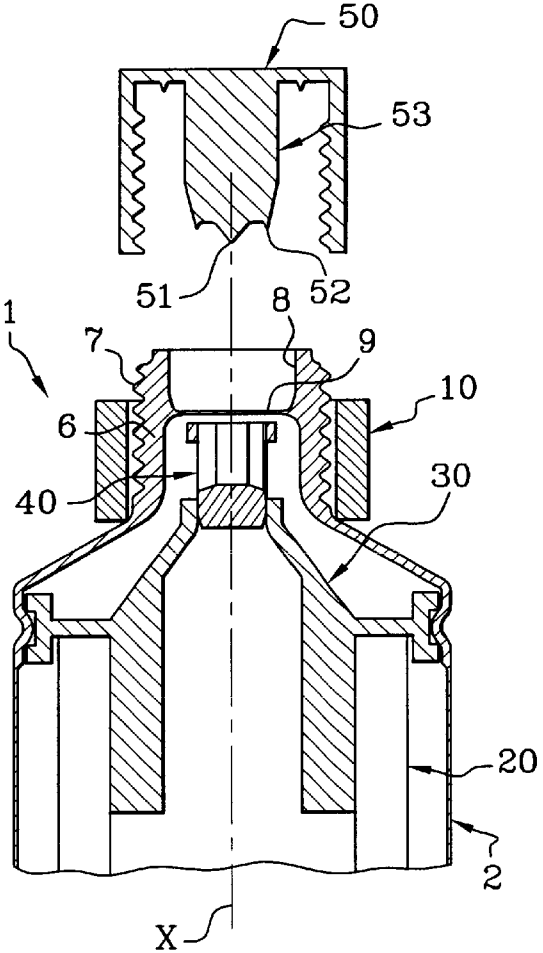
FIG. 5A is a partial cross-sectional view of an optional embodiment of a stage of using a dispensing device.
Figure 5F:
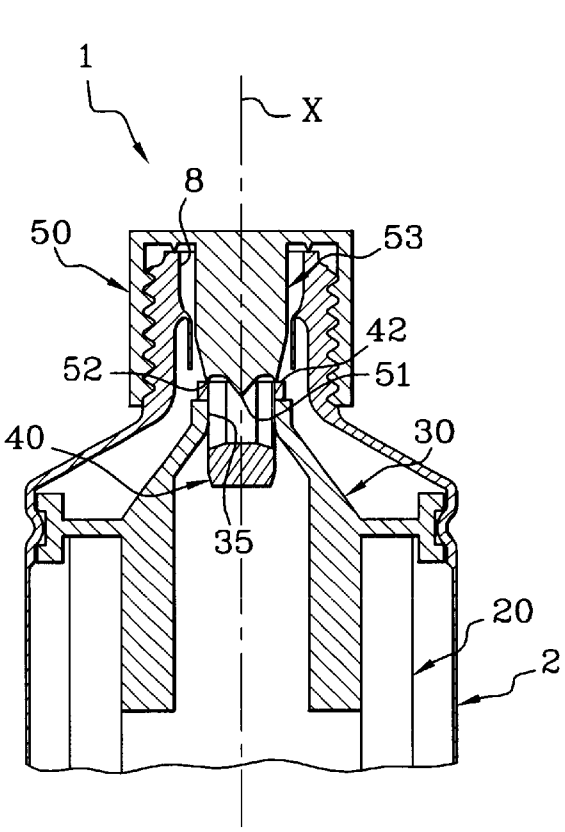
FIG. 5F is a partial cross-sectional view of an optional embodiment of another stage of using a dispensing device.

Prior to first use, the closure 50 may be unscrewed from the neck portion 6, as shown in FIG. 5A, and the ring 10 may be removed from the neck portion 6, as shown in FIG. 5B. Once the ring 10 is removed, the closure 50 may be screwed onto the neck portion 6, as shown in FIG. 5C.

Figure 5E:
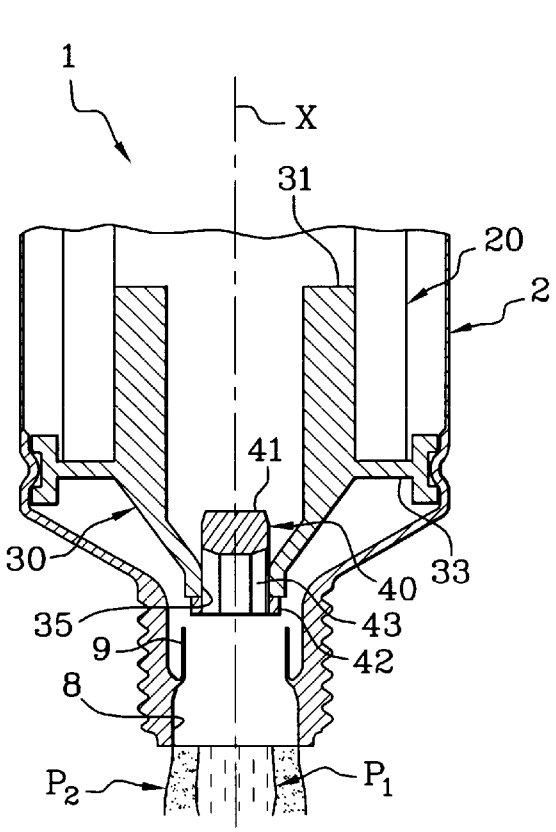
FIG. 5E is a partial cross-sectional view of an optional embodiment of yet another stage of using a dispensing device.
Figure 5D:
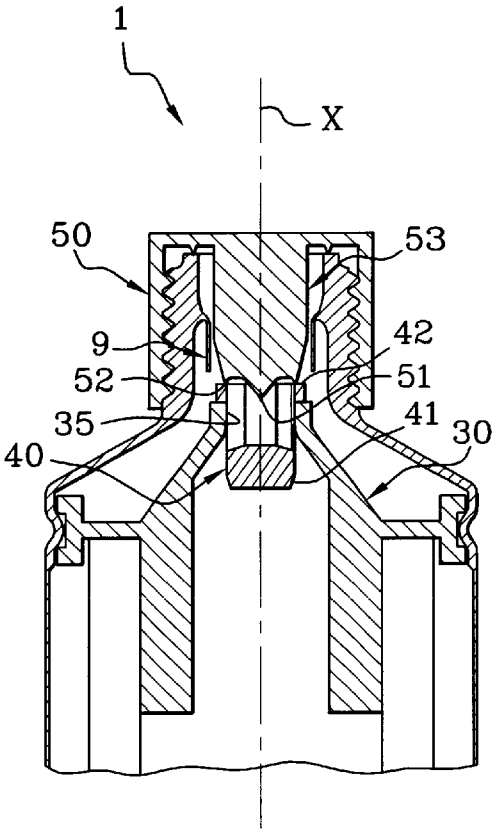
FIG. 5D is a partial cross-sectional view of an optional embodiment of another stage of using a dispensing device.

In screwing the closure 50 onto the neck portion 6, as illustrated in FIG. 5D, the sealing element 9 may be torn by the sharpened trocar 51 formed at the end of the stopper member 53 carried by the closure 50. By continuing the movement of screwing the closure 50 onto the neck portion 6, the stopper 53 comes into engagement with the flow control member 40 and pushes it in until the annular rim 42 abuts against the edge delimiting the opening 35 of the mounting member 30. In this position, the sealing lip 52 of the closure 50 may be pressed sealingly against the annular rim 42 of the flow control member 40. This may allow the opening 35 to be kept closed.

To jointly dispense the first and second products, $P_1$, $P_2$, the closure 50 is unscrewed and removed and the device 1 is inverted, as shown in FIG. 5E. In this configuration, the inside of the first container 20 is in communication with the outlet 8 of the device 1 via the passages defined between the tabs 43 of the flow control member 40. The second reservoir between the first container 20 and the second container 2 and containing the second product $P_2$ also may be in communication with the outlet 8 of the device 1 via the passages defined between the tabs 33 of the mounting member 30. The products P1 and P2 may be dispensed jointly through the outlet 8, for example, by pressing on the walls of the second container 2. The product P1 may be substantially surrounded by a "sheath" formed of the product P2. The respective flow rates of products P1 and P2 depend on various factors, such as the ratio of the respective cross-sections of the first container 20 and of the second container 2, for example.

After the desired amount of the two products have been dispensed, the device 1 may be returned to its upright position and the closure 50 may be screwed back onto the neck portion 6. In this position, depicted in FIG. 5F, the sealing lip 52 of the closure 50 may plug the opening 35 of the mounting member 30 and keep the product P1 isolated from the product P2. The closure 50 also may plug the outlet 8 of the device 1. The device can thus be stored until further use.

It should be noted that sizes of various structural parts and materials used to make these parts are illustrative and exemplary only and one of ordinary skill in the art would recognize that these sizes and materials can be changed as necessary to produce different effects or desired characteristics of the application device. Moreover, although many of the embodiments discussed above referred to a dispensing device wherein first container in the form of a bag and the second container was in the form of a tube, other types of first and second containers can be envisioned, such as bottles, for example, and are considered to be within the scope of the invention. Further, it is envisioned that the first and second containers may be formed from a single piece construction as opposed to the separate construction shown in the figures.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A dispensing device comprising:

a first container defining a first reservoir configured to hold a first product;

a second container at least partially surrounding the first container, the first container and the second container defining therebetween a second reservoir configured to hold a second product;

an outlet configured to permit flow of the first product and the second product from the device;

a flow control member moveable from a first position in which the flow control member prevents flow of the first product from the first reservoir, to a second position in which the flow control member permits flow of the first product from the first reservoir; and a closure configured to be placed in a storage position in which the closure prevents flow of product through the outlet and prevents flow of the first product from the first reservoir, the closure being moveable relative to the flow control member.

2. The dispensing device of claim 1, wherein, in the storage position, the closure is configured to prevent flow communication between the first reservoir and the second reservoir.

3. The dispensing device of claim 1, wherein the first reservoir and the second reservoir are in flow communication with each other when the closure is moved from the storage position and the flow control member is in the second position.

4. The dispensing device of claim 1, wherein, when the closure is in the storage position, the closure is configured to prevent flow of the first product via the flow control member when the flow control member is in the second position.

5. The dispensing device of claim 1, further comprising an opening associated with the first container for flowing the first product from the first reservoir, wherein the flow control member is configured to close the opening in the first position.

6. The dispensing device of claim 5, wherein the flow control member comprises a solid portion, the solid portion being configured to close the opening when the flow control member is in the first position.

7. The dispensing device of claim 6, wherein the flow control member defines at least one passage, the at least one passage providing flow communication between the first reservoir and the second reservoir when the flow control member is in the second position.

8. The dispensing device of claim 7, wherein the flow control member comprises an annular rim configured to abut a free edge of the first container defining the opening when the flow control member is in the second position.

9. The dispensing device of claim 5, wherein the opening is configured to be closed at least partially by the closure when the closure is in the storage position.

10. The dispensing device of claim 9, wherein the closure includes a stopper portion configured to plug the opening and a skirt portion surrounding the stopper portion.

11. The dispensing device of claim 10, wherein the skirt portion covers the outlet when the closure is in the storage position.

12. The dispensing device of claim 10, wherein the skirt portion includes screw threading.

13. The dispensing device of claim 12, further comprising a neck portion including screw threading, wherein the screw threading on the closure is configured to engage with screw threading on the neck portion.

14. The dispensing device of claim 13, wherein the neck portion is connected to the second container.

15. The dispensing device of claim 14, wherein the second container and the neck portion are a single piece.

16. The dispensing device of claim 10, wherein the closure is configured to close the outlet to prevent flow of product through the outlet and to close the opening when the closure is in the storage position.

17. The dispensing device of claim 1, further comprising an opening associated with the first container for flowing the first product from the first reservoir, the opening being disposed at an axial position differing from the axial position of the outlet.

18. The dispensing device of claim 1, further comprising a flange element configured to prevent the closure from moving to the storage position prior to a first use of the device for dispensing the first and second products.

19. The dispensing device of claim 18, wherein the flange element is detachable.

20. The dispensing device of claim 19, further comprising a neck portion, wherein the flange element is in the form of a ring configured to surround the neck portion.

21. The dispensing device of claim 20, wherein the neck portion comprises screw threading configured to engage with screw threading on the closure.

22. The dispensing device of claim 21, wherein the ring is configured to surround at least part of the screw threading on the neck portion.

23. The dispensing device of claim 1, wherein the closure includes screw threading configured to engage with screw threading on a portion of the second container.

24. The dispensing device of claim 23, wherein the closure is configured to be placed in the storage position by screwing the closure onto a portion of the second container.

25. The dispensing device of claim 1, further comprising a protective sealing element configured to seal the outlet prior to a first use of the device for dispensing the first and second products.

26. The dispensing device of claim 25, wherein the closure comprises a sharpened member configured to pierce the sealing element.

27. The dispensing device of claim 26, wherein the sharpened member is configured to pierce the sealing element when the closure is placed in the storage configuration prior to the first use of the device for dispensing.

28. The dispensing device of claim 1, wherein the first container and the second container have substantially the same axial height.

29. The dispensing device of claim 1, wherein the device is configured such that a flow rate of each of the first product and the second product during dispensing of the first and second products is a function of a ratio of the transverse cross-section of the first container and the transverse cross-section of the second container.

30. The dispensing device of claim 1, wherein the flow control member is in the first position at least prior to a first use of the dispensing device for dispensing product.

31. The dispensing device of claim 1, wherein at least part of the second container is made of a deformable material.

32. The dispensing device of claim 1, wherein at least part of the second container is in the form of a tube.

33. The dispensing device of claim 1, wherein at least part of the second container is made by one of molding and extruding.

34. The dispensing device of claim 33, wherein at least the part of the second container is made of a material chosen from aluminum and a multi-layer complex comprising at least one layer of aluminum.

35. The dispensing device of claim 1, wherein at least part of the first container is made of a deformable material.

36. The dispensing device of claim 1, wherein pressure exerted on the second container causes the first product and the second product to flow together from the outlet when the flow control member is in the second position and the closure is not in the storage position.

37. The dispensing device of claim 1, further comprising a mounting member for mounting the first container within the second container.

38. The dispensing device of claim 37, wherein the mounting member defines at least one passage for flowing the second product from the second reservoir.

39. The dispensing device of claim 1, further comprising the first product and the second product, and wherein at least one of the first product, the second product, and a mixture of the first and second products is a product intended to be applied to at least one of one of hair, skin, and nails.

40. The dispensing device of claim 39, wherein at least one of the first product, the second product, and a mixture of the first and second products is a product for coloring hair.

41. A method of dispensing, comprising:

providing the dispensing device of claim 1;

placing the flow control member in the second position;

moving the closure from the storage position; and flowing the first product and the second product through the outlet.

42. The method of claim 41, wherein the placing of the flow control member comprises placing the closure in the storage position at least prior to a first use of the device for dispensing.

43. The method of claim 41, wherein the closure comprises screw threading configured to engage with screw threading on a portion of the device, wherein the method further comprises placing the closure in the storage position by screwing the closure on the device.

44. The method of claim 43, wherein the moving of the closure from the storage position comprises unscrewing the closure from the device.

45. The method of claim 41, wherein the flowing of the first product and the second product from the outlet comprises exerting pressure on the second container.

46. The method of claim 41, wherein the moving of the closure from the storage position places the first reservoir and the second reservoir in flow communication with each other.

47. The method of claim 41, wherein the dispensing device further comprises a sealing element configured to seal the outlet prior to a first use of the dispensing device for dispensing, and wherein the method further comprises moving at least a portion of the sealing element to enable flow via the outlet.

48. The method of claim 47, wherein the closure comprises a sharpened member and the moving of the sealing element comprises piercing the sealing element with the sharpened member.

49. A method of storing and dispensing first and second products, comprising:

providing the dispensing device of claim 1;

preventing via the flow control member flow communication between the first reservoir and the second reservoir prior to a first dispensing of the first product and the second product;

moving the flow control member so as to place the first reservoir in flow communication with the second reservoir;

flowing the first product and the second product from the first reservoir and the second reservoir, respectively, and out of the device; and after flowing the first product and the second product out of the device, preventing, other than via the flow control member, flow communication between the first reservoir and the second reservoir.

50. The method of claim 49, wherein the moving of the flow control member comprises moving the flow control member to the second position.

51. The method of claim 49, wherein the preventing via the flow control member comprises preventing the first product to flow from the first reservoir.

52. The method of claim 49, wherein the preventing other than via the flow control member comprises preventing via the closure placed in the storage position.

53. The method of claim 49, wherein the flowing of the first and second products out of the device comprises flowing the first and second products through the outlet.

54. The method of claim 49, wherein the flowing of the first and second products includes exerting pressure the second container.

55. The method of claim 49, wherein the moving of the flow control member occurs at least prior to a first flowing of the first and second products out of the device.

56. A dispensing device comprising:

a first container defining a first reservoir configured to hold a first product;

a second container at least partially surrounding the first container, the first container and the second container defining therebetween a second reservoir configured to hold a second product;

an outlet configured to permit flow of the first product and the second product from the device;

a flow control member moveable from a first position in which the flow control member prevents flow of the first product from the first reservoir, to a second position in which the flow control member permits flow of the first product from the first reservoir; and a closure configured to be placed in a storage position in which the closure prevents flow of product through the outlet and prevents flow of the first product from the first reservoir, wherein, at least prior to a first use of the device for dispensing the first and second products, the closure is spaced from the flow control member.

57. The dispensing device of claim 56, wherein, in the storage position, the closure is configured to prevent flow communication between the first reservoir and the second reservoir.

58. The dispensing device of claim 56, wherein the first reservoir and the second reservoir are in flow communication with each other when the closure is moved from the storage position and the flow control member is in the second position.

59. The dispensing device of claim 56, wherein movement of the closure to the storage position at least prior to a first use of the device for dispensing the first and second products places the flow control member in the second position.

60. The dispensing device of claim 59, wherein, when the closure is in the storage position, the closure is configured to prevent flow of the first product via the flow control member when the flow control member is in the second position.

61. The dispensing device of claim 56, further comprising a flange element configured to prevent the closure from moving to the storage position prior to a first use of the device for dispensing the first and second products.

62. The dispensing device of claim 56, further comprising a protective sealing element configured to seal the outlet prior to a first use of the device for dispensing the first and second products.

63. The dispensing device of claim 62, wherein the closure comprises a sharpened member configured to pierce the sealing element.

64. The dispensing device of claim 63, wherein the sharpened member is configured to pierce the sealing element when the closure is placed in the storage configuration prior to the first use of the device for dispensing.

65. The dispensing device of claim 56, further comprising an opening associated with the first container for flowing the first product from the first reservoir, wherein the opening is configured to be closed at least partially by the closure when the closure is in the storage position.

66. The dispensing device of claim 65, wherein the closure is configured to close the outlet to prevent flow of product through the outlet and to close the opening when the closure is in the storage position.

67. The dispensing device of claim 56, wherein movement of the closure to the storage position at least prior to a first use of the device causes movement of the flow control member to the second position.

68. The dispensing device of claim 56, further comprising the first product and the second product, and wherein at least one of the first product, the second product, and a mixture of the first and second products is a product intended to be applied to at least one of one of hair, skin, and nails.

69. A dispensing device comprising:

a first container defining a first reservoir configured to hold a first product;

a second container at least partially surrounding the first container, the first container and the second container defining therebetween a second reservoir configured to hold a second product;

an outlet configured to permit flow of the first product and the second product from the device;

a flow control member moveable from a first position in which the flow control member prevents flow of the first product from the first reservoir, to a second position in which the flow control member permits flow of the first product from the first reservoir; and a closure configured to be placed in a storage position in which the closure prevents flow of product through the outlet and prevents flow of the first product from the first reservoir, wherein movement of the closure to the storage position at least prior to a first use of the device causes movement of the flow control member to the second position.

70. The dispensing device of claim 69, wherein, in the storage position, the closure is configured to prevent flow communication between the first reservoir and the second reservoir.

71. The dispensing device of claim 69, wherein the first reservoir and the second reservoir are in flow communication with each other when the closure is moved from the storage position and the flow control member is in the second position.

72. The dispensing device of claim 69, wherein, when the closure is in the storage position, the closure is configured to prevent flow of the first product via the flow control member when the flow control member is in the second position.

73. The dispensing device of claim 69, further comprising a flange element configured to prevent the closure from moving to the storage position prior to a first use of the device for dispensing the first and second products.

74. The dispensing device of claim 69, further comprising a protective sealing element configured to seal the outlet prior to a first use of the device for dispensing the first and second products.

75. The dispensing device of claim 74, wherein the closure comprises a sharpened member configured to pierce the sealing element.

76. The dispensing device of claim 75, wherein the sharpened member is configured to pierce the sealing element when the closure is placed in the storage configuration prior to the first use of the device for dispensing.

77. The dispensing device of claim 69, further comprising an opening associated with the first container for flowing the first product from the first reservoir, wherein the opening is configured to be closed at least partially by the closure when the closure is in the storage position.

78. The dispensing device of claim 77, wherein the closure is configured to close the outlet to prevent flow of product through the outlet and to close the opening when the closure is in the storage position.

79. The dispensing device of claim 69, further comprising the first product and the second product, and wherein at least one of the first product, the second product, and a mixture of the first and second products is a product intended to be applied to at least one of one of hair, skin, and nails.

80. A dispensing device comprising:

a first container defining a first reservoir configured to hold a first product;

a second container at least partially surrounding the first container, the first container and the second container defining therebetween a second reservoir configured to hold a second product;

an outlet configured to permit flow of the first product and the second product from the device;

a flow control member moveable from a first position in which the flow control member prevents flow communication between the first reservoir and the second reservoir, to a second position in which the flow control member permits flow communication between the first reservoir and the second reservoir; and a closure configured to be placed in a storage position in which the closure prevents flow of product through the outlet and prevents flow communication between the first reservoir and the second reservoir the closure being moveable relative to the flow control member.

81. The dispensing device of claim 80, wherein flow communication between the first reservoir and the second reservoir is prevented when one of the closure is in the storage position and the flow control member is in the first position.

82. The dispensing device of claim 80, wherein movement of the closure to the storage position at least prior to a first use of the device for dispensing the first and second products places the flow control member in the second position.

83. The dispensing device of claim 80, further comprising an opening associated with the first container for flowing the first product from the first reservoir, wherein the flow control member is configured to close the opening when the flow control member is in the first position.

84. The dispensing device of claim 83, wherein the flow control member comprises a solid portion, the solid portion being configured to close the opening when the flow control member is in the first position.

85. The dispensing device of claim 84, wherein the flow control member defines at least one passage, the at least one passage providing flow communication between the first reservoir and the second reservoir when the flow control member is in the second position.

86. The dispensing device of claim 85, wherein the flow control member comprises an annular rim configured to abut a free edge of the first container defining the opening when the flow control member is in the second position.

87. The dispensing device of claim 83, wherein the opening is configured to be closed at least partially by the closure when the closure is in the storage position.

88. The dispensing device of claim 87, wherein the closure includes a stopper portion configured to plug the opening and a skirt portion surrounding the stopper portion.

89. The dispensing device of claim 88, wherein the skirt portion covers the outlet when the closure is in the storage position.

90. The dispensing device of claim 88, wherein the skirt portion includes screw threading.

91. The dispensing device of claim 90, further comprising a neck portion including screw threading, wherein the screw threading on the closure is configured to engage with screw threading on the neck portion.

92. The dispensing device of claim 91, wherein the second container is connected to the neck portion.

93. The dispensing device of claim 92, wherein the second container and the neck portion are a single piece.

94. The dispensing device of claim 87, wherein the closure is configured to close the outlet to prevent flow of product through the outlet and to close the opening when the closure is in the storage position.

95. The dispensing device of claim 80, further comprising an opening associated with the first container for flowing the first product from the first reservoir, the opening being disposed at an axial position differing from the axial position of the outlet.

96. The dispensing device of claim 80, wherein, at least prior to a first use of the device for dispensing the first and second products, the closure is spaced from the flow control member.

97. The dispensing device of claim 80, further comprising a flange element configured to prevent the closure from moving to the storage position prior to a first use of the device for dispensing the first and second products.

98. The dispensing device of claim 97, wherein the flange element is detachable.

99. The dispensing device of claim 98, further comprising a neck portion, wherein the flange element is in the form of a ring configured to surround the neck portion.

100. The dispensing device of claim 99, wherein the neck portion comprises screw threading configured to engage with screw threading on the closure.

101. The dispensing device of claim 100, wherein the ring is configured to surround at least part of the screw threading on the neck portion.

102. The dispensing device of claim 80, wherein the closure includes screw threading configured to engage with screw threading on a portion of the second container.

103. The dispensing device of claim 102, wherein the closure is configured to be placed in the storage position by screwing the closure onto the portion of the second container.

104. The dispensing device of claim 80, further comprising a protective sealing element configured to seal the outlet prior to a first use of the device for dispensing the first and second products.

105. The dispensing device of claim 104, wherein the closure comprises a sharpened member configured to pierce the sealing element.

106. The dispensing device of claim 105, wherein the sharpened member is configured to pierce the sealing element when the closure is placed in the storage position prior to the first use of the device for dispensing.

107. The dispensing device of claim 80, wherein the first container and the second container have substantially the same axial height.

108. The dispensing device of claim 80, wherein the device is configured such that a flow rate of each of the first product and the second product during dispensing of the first and second products is a function of a ratio of the transverse cross-section of the first container and the transverse cross-section of the second container.

109. The dispensing device of claim 80, wherein movement of the closure to the storage configuration at least prior to a first use of the device causes movement of the flow control member to the second position.

110. The dispensing device of claim 80, wherein the flow control member is in the first position at least prior to a first use of the dispensing device for dispensing product.

111. The dispensing device of claim 80, wherein at least part of the second container is made of a deformable material.

112. The dispensing device of claim 80, wherein at least part of the second container is in the form of a tube.

113. The dispensing device of claim 80, wherein at least part of the second container is made by one of molding and extruding.

114. The dispensing device of claim 113, wherein at least the part of the second container is made of a material chosen from aluminum and a multi-layer complex comprising at least one layer of aluminum.

115. The dispensing device of claim 80, wherein at least part of the first container is made of a deformable material.

116. The dispensing device of claim 80, wherein pressure exerted on the second container causes the first product and the second product to flow together from the outlet when the flow control member is in the second position and the closure is not in the storage position.

117. The dispensing device of claim 80, further comprising a mounting member for mounting the first container within the second container.

118. The dispensing device of claim 117, wherein the mounting member defines at least one passage for flowing the second product from the second reservoir.

119. The dispensing device of claim 80, further comprising the first product and the second product, and wherein at least one of the first product, the second product, and a mixture of the first product and the second product is a product intended to be applied to at least one of one of hair, skin, and nails.

120. The dispensing device of claim 119, wherein at least one of the first product, the second product, and a mixture of the first product and the second product is for coloring hair.

121. A method of dispensing, comprising:

providing the dispensing device of claim 80;

placing the flow control member in the second position;

moving the closure from the storage position; and flowing the first product and the second product through the outlet.

122. The method of claim 121, wherein the placing of the flow control member comprises placing the closure in the storage position at least prior to a first use of the device for dispensing.

123. The method of claim 122, wherein the closure comprises screw threading configured to engage with screw threading on a portion of the device, wherein the method further comprises placing the closure in the storage position by screwing the closure on the device.

124. The method of claim 123, wherein the moving of the closure from the storage position comprises unscrewing the closure from the device.

125. The method of claim 122, wherein the flow control member is placed in the second position prior to a first use of the dispensing device for dispensing.

126. The method of claim 122, wherein the flowing of the first product and the second product from the outlet comprises exerting pressure on the second container.

127. The method of claim 122, wherein the moving of the closure from the storage position permits the first product to flow from the first reservoir.

128. The method of claim 122, wherein the dispensing device further comprises a sealing element configured to seal the outlet prior to a first use of the dispensing device for dispensing, and wherein the method further comprises moving at least a portion of the sealing element to enable flow via the outlet.

129. The method of claim 128, wherein the closure comprises a sharpened member and the moving of the sealing element comprises piercing the sealing element with the sharpened member.

130. The dispensing device of claim 80, wherein, in the storage position, the closure is configured to prevent flow of the first product from the first reservoir.

131. A method of storing and dispensing first and second products, comprising:

providing the dispensing device of claim 80;

preventing via the flow control member flow communication between the first reservoir and the second reservoir prior to a first dispensing of the first product and the second product;

moving the flow control member to the second position so as to place the first reservoir in flow communication with the second reservoir;

flowing the first product and the second product from the first reservoir and the second reservoir, respectively, and out of the device; and after flowing the first product and the second product out of the device, preventing, other than via the flow control member flow communication, between the first reservoir and the second reservoir.

132. The method of claim 131, wherein the preventing via the flow control member further comprises preventing the first product to flow from the first reservoir.

133. The method of claim 131, wherein the preventing other than via the flow control member comprises preventing via the closure placed in the storage position.

134. The method of claim 131, wherein the flowing of the first and second products out of the device comprises flowing the first and second products through the outlet.

135. The method of claim 131, wherein the flowing of the first and second products includes exerting pressure on the second container.

136. The method of claim 131, wherein the moving of the flow control member occurs at least prior to a first flowing of the first and second products out of the device.

137. A method of storing and dispensing first and second products, comprising:

providing a device comprising at least a first reservoir containing a first product, a second reservoir containing a second product, and a flow control member;

preventing via the flow control member flow communication between the first reservoir and the second reservoir prior to a first dispensing of the first product and the second product;

moving the flow control member so as to place the first reservoir in flow communication with the second reservoir;

flowing the first product and the second product from the first reservoir and the second reservoir, respectively, and out of the device; and after flowing the first product and the second product out of the device, preventing, other than via the flow control member, flow communication between the first reservoir and the second reservoir.

138. The method of claim 137, wherein the preventing via the flow control member comprises preventing the first product to flow from the first reservoir.

139. The method of claim 137, wherein the preventing other than via the flow control member comprises preventing via a closure configured to be placed in a storage position in which the closure prevents flow out of the device.

140. The method of claim 137, wherein the flowing of the first and second products out of the device comprises flowing the first and second products through an outlet of the device.

141. The method of claim 137, wherein the flowing of the first and second products includes exerting pressure on a portion of the device.

142. The method of claim 141, wherein the portion of the device defines the second reservoir.

143. The method of claim 137, wherein the moving of the flow control member occurs at least prior to a first flowing of the first and second products out of the device.

144. A dispensing device comprising:

a first container defining a first reservoir configured to hold a first product;

a second container at least partially surrounding the first container, the first container and the second container defining therebetween a second reservoir configured to hold a second product;

an outlet configured to permit flow of the first product and the second product from the device;

a flow control member moveable from a first position in which the flow control member prevents flow of the first product from the first reservoir, to a second position in which the flow control member permits flow of the first product from the first reservoir, the flow control member defining at least one passage; and closure configured to be placed in a storage position in which the closure prevents flow of product through the outlet and prevents flow of the first product from the first reservoir.

145. The dispensing device of claim 144, wherein, in the storage position, the closure is configured to prevent flow communication between the first reservoir and the second reservoir.

146. The dispensing device of claim 144, wherein the first reservoir and the second reservoir are in flow communication with each other when the closure is moved from the storage position and the flow control member is in the second position.

147. The dispensing device of claim 144, wherein movement of the closure to the storage position at least prior to a first use of the device for dispensing the first and second products places the flow control member in the second position.

148. The dispensing device of claim 147, wherein, when the closure is in the storage position, the closure is configured to prevent flow of the first product via the flow control member when the flow control member is in the second position.

149. The dispensing device of claim 144, further comprising an opening associated with the first container for flowing the first product from the first reservoir, wherein the flow control member is configured to close the opening in the first position.

150. The dispensing device of claim 149, wherein the flow control member comprises a solid portion, the solid portion being configured to close the opening when the flow control member is in the first position.

151. The dispensing device of claim 149, wherein the opening is configured to be closed at least partially by the closure when the closure is in the storage position.

152. The dispensing device of claim 151, wherein the closure includes a stopper portion configured to plug the opening and a skirt portion surrounding the stopper portion.

153. The dispensing device of claim 152, wherein the skirt portion covers the outlet when the closure is in the storage position.

154. The dispensing device of claim 152, wherein the closure is configured to close the outlet to prevent flow of product through the outlet and to close the opening when the closure is in the storage position.

155. The dispensing device of claim 144, wherein the at least one passage provides flow communication between the first reservoir and the second reservoir when the flow control member is in the second position.

156. The dispensing device of claim 155, wherein the flow control member comprises an annular rim configured to abut a free edge of the first container defining the opening when the flow control member is in the second position.

157. The dispensing device of claim 144, further comprising an opening associated with the first container for flowing the first product from the first reservoir, the opening being disposed at an axial position differing from the axial position of the outlet.

158. The dispensing device of claim 144, wherein, at least prior to a first use of the device for dispensing the first and second products, the closure is spaced from the flow control member.

159. The dispensing device of claim 144, further comprising a flange element configured to prevent the closure from moving to the storage position prior to a first use of the device for dispensing the first and second products.

160. The dispensing device of claim 144, further comprising a protective sealing element configured to seal the outlet prior to a first use of the device for dispensing the first and second products.

161. The dispensing device of claim 160, wherein the closure comprises a sharpened member configured to pierce the sealing element.

162. The dispensing device of claim 161, wherein the sharpened member is configured to pierce the sealing element when the closure is placed in the storage configuration prior to the first use of the device for dispensing.

163. The dispensing device of claim 144, wherein the device is configured such that a flow rate of each of the first product and the second product during dispensing of the first and second products is a function of a ratio of the transverse cross-section of the first container and the transverse cross-section of the second container.

164. The dispensing device of claim 144, wherein the flow control member is in the first position at least prior to a first use of the dispensing device for dispensing product.

165. The dispensing device of claim 144, wherein pressure exerted on the second container causes the first product and the second product to flow together from the outlet when the flow control member is in the second position and the closure is not in the storage position.

166. The dispensing device of claim 144, further comprising the first product and the second product, and wherein at least one of the first product, the second product, and a mixture of the first and second products is a product intended to be applied to at least one of one of hair, skin, and nails.

167. The dispensing device of claim 166, wherein at least one of the first product, the second product, and a mixture of the first and second products is a product for coloring hair.

168. A method of dispensing, comprising:

providing the dispensing device of claim 144;

placing the flow control member in the second position;

moving the closure from the storage position; and flowing the first product and the second product through the outlet.

169. The method of claim 168, wherein the placing of the flow control member comprises placing the closure in the storage position at least prior to a first use of the device for dispensing.

170. The method of claim 168, wherein the closure comprises screw threading configured to engage with screw threading on a portion of the device, wherein the method further comprises placing the closure in the storage position by screwing the closure on the device.

171. The method of claim 170, wherein the moving of the closure from the storage position comprises unscrewing the closure from the device.

172. The method of claim 168, wherein the moving of the closure from the storage position places the first reservoir and the second reservoir in flow communication with each other.

173. The method of claim 168, wherein the dispensing device further comprises a sealing element configured to seal the outlet prior to a first use of the dispensing device for dispensing, and wherein the method further comprises moving at least a portion of the sealing element to enable flow via the outlet.

174. The method of claim 173, wherein the closure comprises a sharpened member and the moving of the sealing element comprises piercing the sealing element with the sharpened member.

175. A method of making the dispensing device of claim 1, the method comprising:

providing the first container;

placing the flow control member in the first position;

filling the first reservoir with the first product;

sealing the outlet;

inserting the first container within the second container; and filling the second reservoir with the second product.

176. The method of claim 175, wherein the filling of the first reservoir comprises filling the first reservoir through an open end of the first container.

177. The method of claim 176, further comprising sealing the open end of the first container after the filling of the first reservoir.

178. The method of claim 175, wherein the filling of the second reservoir comprises filling the second reservoir through an open end of the second container.

179. The method of claim 178, further comprising sealing the open end of the second container after the filling of the second reservoir.

180. The method of claim 175, further comprising positioning the first and second containers in an inverted position during the filling of the first reservoir and the second reservoir.

181. The method of claim 175, wherein the sealing of the outlet comprises sealing the outlet with a sealing element.

182. The method of claim 175, wherein the device further comprises a neck portion associated with the second container and the method further comprises placing a flange element around at least part of the neck portion.

183. The method of claim 182, wherein the method further comprises providing the closure on the neck portion above the flange element.

184. A method of making the dispensing device of claim 80, the method comprising:

providing the first container;

placing the flow control member in the first position;

filling the first reservoir with the first product;

sealing the outlet;

inserting the first container within the second container; and filling the second reservoir with the second product.

185. The method of claim 184, wherein the filling of the first reservoir comprises filling the first reservoir through an open end of the first container.

186. The method of claim 185, further comprising sealing the open end of the first container after the filling of the first reservoir.

187. The method of claim 184, wherein the filling of the second reservoir comprises filling the second reservoir through an open end of the second container.

188. The method of claim 187, further comprising sealing the open end of the second container after the filling of the second reservoir.

189. The method of claim 184, further comprising placing the first and second containers in an inverted position during the filling of the first reservoir and the second reservoir.

190. The method of claim 184, wherein the sealing of the outlet comprises sealing the outlet with a sealing element.

191. The method of claim 184, wherein the device further comprises a neck portion associated with the second container and the method further comprises placing a flange element around at least part of the neck portion.

192. The method of claim 191, wherein the method further comprises providing the closure on the neck portion above the flange element.

* * * * *

UNITED STATES PATENT AND TRADEMARK OFFICE

CERTIFICATE OF CORRECTION

PATENT NO. : 6,609,634 B2
DATED : August 26, 2003
INVENTOR(S) : Vincent De Laforcade et al.

It is certified that error appears in the above-identified patent and that said Letters Patent is hereby corrected as shown below:

Title page,
Item [57], ABSTRACT,
Line 13, replace "first reservoirs," with -- first reservoir, --;

Column 13,
Line 43, replace "at least one of one of hair," with -- at least one of hair, --;

Column 14,
Line 46, after "exerting pressure" insert -- on --;

Column 15,
Line 55, replace "at least one of one of hair," with -- at least one of hair, --;

Column 16,
Line 52, replace "at least one of one of hair," with -- at least one of hair, --;

Signed and Sealed this

Fourth Day of November, 2003

JAMES E. ROGAN
*Director of the United States Patent and Trademark Office*